US005169273A

United States Patent [19]

Kawamura

[11] Patent Number: 5,169,273

[45] Date of Patent: Dec. 8, 1992

[54] PACKAGE TRANSFER APPARATUS

[75] Inventor: Shuzo Kawamura, Joyo, Japan

[73] Assignee: Murata Kikai Kabushiki Kaisha, Kyoto, Japan

[21] Appl. No.: 662,248

[22] Filed: Feb. 27, 1991

[30] Foreign Application Priority Data

Mar. 2, 1990 [JP] Japan ..... 2-20500[U]

[51] Int. Cl.[5] ..... B65G 47/52

[52] U.S. Cl. ..... 414/331; 198/426; 198/427; 198/477.1; 414/416; 414/911; 414/639

[58] Field of Search ..... 414/276, 277, 281, 331, 414/608, 609, 628, 639, 648, 649, 911, 416, 745.7, 757; 198/418.6, 426, 427, 477.1, 802; 242/35.5 A

[56] References Cited

U.S. PATENT DOCUMENTS

| | | | |
|---|---|---|---|
| 2,969,867 | 1/1961 | McClelland | 414/757 X |
| 3,664,482 | 5/1972 | Kornylak | 198/802 |
| 3,863,778 | 4/1975 | Martin, Sr. | 414/331 |
| 3,924,762 | 12/1975 | Igel | 414/331 |
| 4,153,211 | 5/1979 | Lenk et al. | 414/911 X |
| 4,249,652 | 2/1981 | Brems | 414/416 X |
| 4,354,590 | 10/1982 | Langen | 198/426 |
| 4,669,942 | 6/1987 | Nagasawa | 414/331 |
| 4,770,286 | 9/1988 | Opperthauser | 198/802 X |
| 4,783,021 | 11/1988 | Nagasawa | 414/331 X |
| 4,988,252 | 1/1991 | Yamamoto et al. | 414/331 |

FOREIGN PATENT DOCUMENTS

| | | | |
|---|---|---|---|
| 0940639 | 3/1956 | Fed. Rep. of Germany | 198/802 |
| 0949038 | 9/1956 | Fed. Rep. of Germany | 198/802 |
| 3218253 | 12/1982 | Fed. Rep. of Germany | 414/331 |
| 0113603 | 9/1981 | Japan | 414/745.7 |
| 8204432 | 12/1982 | World Int. Prop. O. | 198/802 |

*Primary Examiner*—Michael S. Huppert
*Assistant Examiner*—James Keenan
*Attorney, Agent, or Firm*—Spensley Horn Jubas & Lubitz

[57] ABSTRACT

A package transfer apparatus comprising flappers which are juxtaposed at a travel start position of a package changing robot having attaching arms for supporting and attaching bobbin ends of packages to pegs of a creel, and are circulated while putting thereon packages supplied from a package supply section, and a tilting mechanism for tilting the flappers to transfer the package to the attaching arms.

4 Claims, 4 Drawing Sheets

PACKAGE TRANSFER APPARATUS

FIELD OF THE INVENTION

The present invention relates to a package transfer apparatus for transferring packages to attaching arms of a package changing robot used for warpers or the like.

RELATED ART STATEMENT

A warper T as shown in FIG. 4 is used to continuously supply a number of warp yarns to the loom. Reference character A designates a beam of the warper T, and two creels 1 are arranged in V form at the rear thereof.

The creel 1 has creel frames 3 having pegs 4 for attaching packages P in a vertical multistage configuration, the creel frames 3 being connected through an endless chain 2, the endless chain 2 being passed over sprockets arranged laterally so that the chain 2 may be circulated. In the creel, a yarn extending between the beam A and the package P is cut when a yarn quantity of packages P arranged on the front side decreases. Then, the packages P are fed toward the back side in order and a yarn of a new package supplied and arranged on the front side is taken out and is introduced to the warper T. A bobbin B with residual yarn is removed from the peg 4 on the bobbin side, and a new package P is attached to the peg 4. Particularly, the package changing work is carried out by hand, which requires a lot of labor.

In view of the foregoing, the present applicant has previously proposed a package changing robot 6 for automatically carrying out the package changing work. The robot 6 is provided to be travelled along the creel 1 and includes a removing unit for collectively removing bobbins B with residual yarns every creel frame 3 and an attaching unit for collectively attaching packages P every creel frame 3. As shown in FIG. 5 and FIG. 6, the attaching unit 11 has a multistage of attaching arms 15 (only one stage is shown in the illustration) corresponding to pegs 4 of the creel frame 3 and a package transfer apparatus for transferring packages P to the attaching arms 15 are disposed at a travel start position of the robot 6.

The aforesaid package transfer apparatus comprises a fixed chute X for guiding packages P supplied from the package supply section so that bobbin ends thereof are put on the attaching arms 15. Therefore, a package distribution device for distributing the packages from the package supply section to respective fixed chutes is separately required, which poses a problem that not only space increases but also when a diameter of a package is small, it is difficult to put the bobbin end on the attaching arm 15. In the figure, reference character Y designates a movable stopper for causing the package P to standby and stop on the fixed chute X.

OBJECT AND SUMMARY OF THE INVENTION

It is therefore an object of the present invention to solve the aforementioned problem and provide a package transfer apparatus which requires no package distribution device, thereby reducing the space required and which can transfer packages to attaching arms of a package changing robot irrespective of the size of the packages.

For achieving the aforesaid object, the present invention provides an arrangement comprising flappers juxtaposed at a travel start position of a package changing robot having attaching arms for supporting and attaching bobbin ends of packages to pegs of a creel and provided to be able to travel along the creel, said flappers circulating while putting thereon packages supplied from a package supply section, and a tilting mechanism for tilting said flappers to transfer the packages to said attaching arms.

The flappers circulate while putting thereon the packages supplied from the package supply section and are tilted by the tilting mechanism at a position of the attaching arm of the package changing robot so as to transfer the packages to the attaching arms.

Since the flappers circulate while putting thereon the packages and transfer them to the attaching arms as described above, the package distribution device need not be provided, thus reducing the space. In addition, since the flappers are tilted to transfer the packages to the attaching arms, the packages can be positively transferred to the attaching arms irrespective to the size of the diameter thereof.

DETAILED DESCRIPTION OF PREFERRED EMBODIMENTS

One embodiment of the present invention will be described in detail with reference to the drawings.

Figure 3:
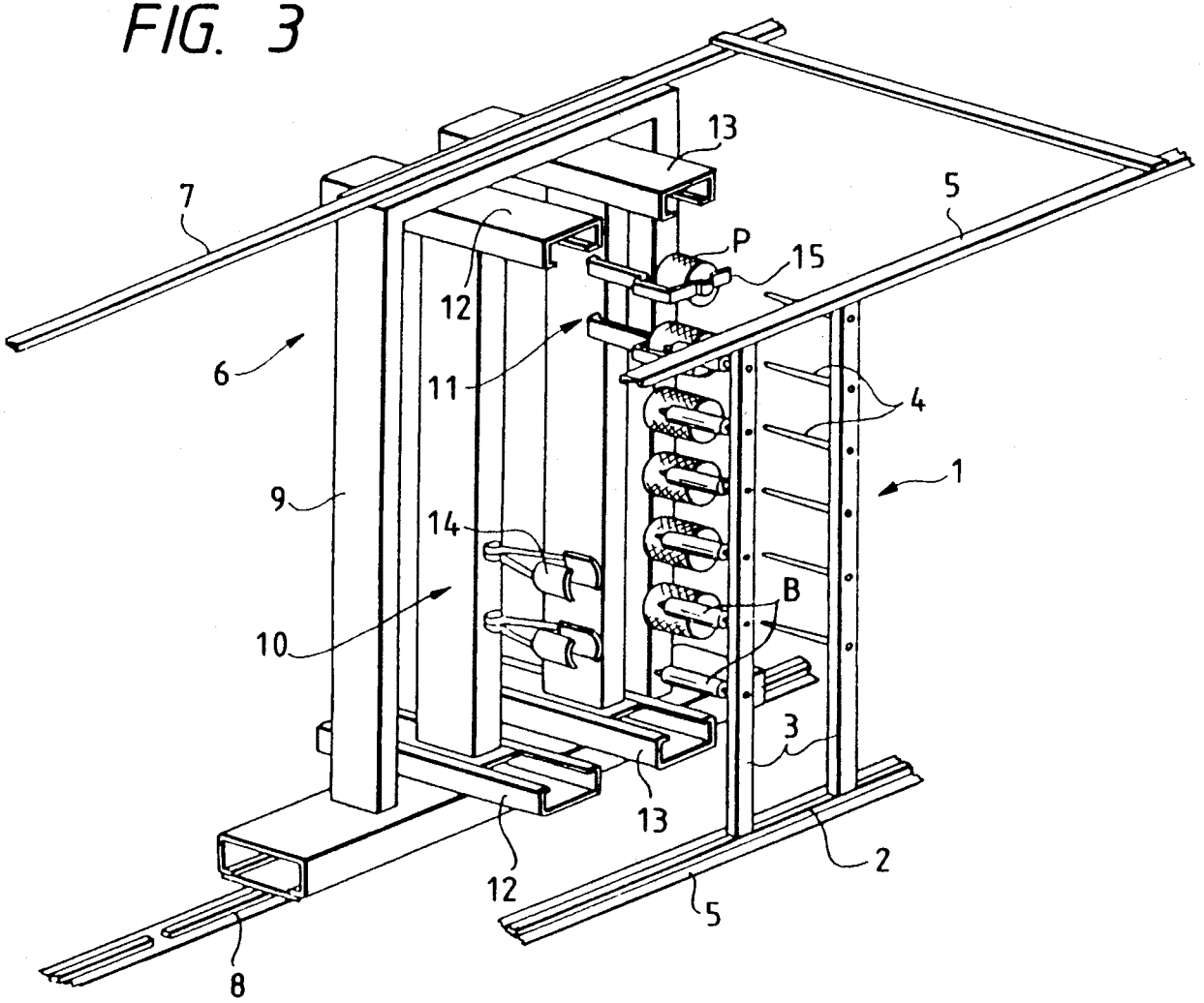
FIG. 3 is a perspective view showing a package changing robot of a warper.
Figure 4:
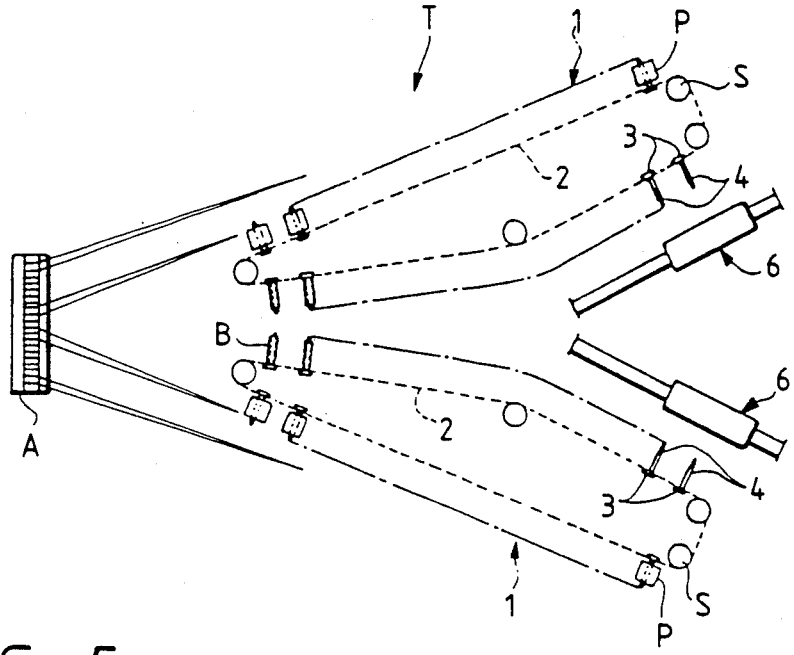
FIG. 4 is a schematic plan view of the warper.
Figure 5:
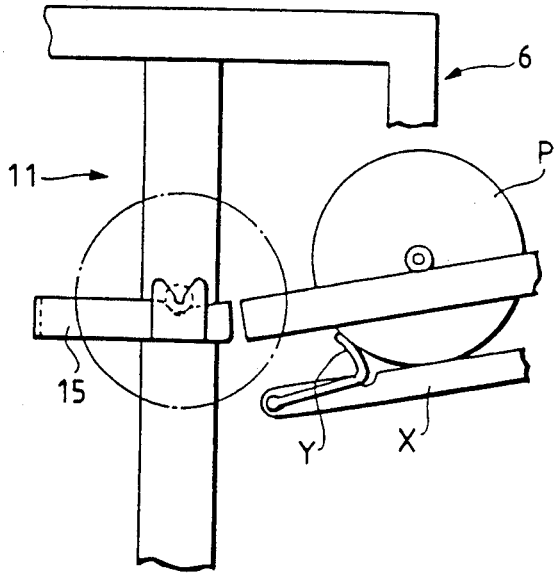
FIG. 5 PRIOR ART
FIG. 5 is a side view showing a conventional package transfer apparatus.
Figure 6:
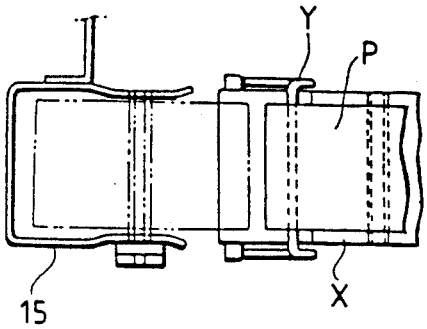
FIG. 6 is a plan view of the apparatus.

In FIG. 3, reference numeral 1 designates a circulation type creel of a warper, in which creel frames 3 are mounted in a predetermined pitch between a pair of upper and lower endless chains 2 horizontally extended through sprockets not shown, and pegs 4 for attaching packages P are vertically, multistage-wise and horizontally projected from one side of each of the creel frames 3. Reference numeral 5 denote rails for guiding upper and lower endless chains 2.

On the side from which pegs are projected of the creel 1 is installed a package changing robot 6 which can travel in a reciprocating manner in a predetermined range along the circulating moving direction thereof. The robot 6 is provided with a carriage 9 supported to be travelled along upper and lower rails 7 and 8. The carriage 9 has a removing unit 10 for collectively removing bobbins B with residual yarns every creel frame 3 and an attaching unit 11 for collectively attaching packages P every creel frame 3, said units 10 and 11 being disposed in the same spacing as the arranging pitch of the creel frames 3. The removing unit 10 and the attaching unit 11 are supported to be moved to and from the pegs 4 through guides 12 and 13 each pair of which is arranged vertically before and behind the travelling direction of the carriage 9.

The removing unit 10 has clampers 14 for clamping bobbins B with residual yarns attached to the pegs 4, the clampers 14 being mounted in a multistage manner corresponding to the pegs 4 of the creel frame 3, the clampers 14 being simultaneously opened and closed by a driving mechanism not shown. The bobbins B with residual yarns removed from the clampers 14 are fallen on a belt conveyor not shown disposed along the lower rail 8 and gathered at one location.

Figure 1:
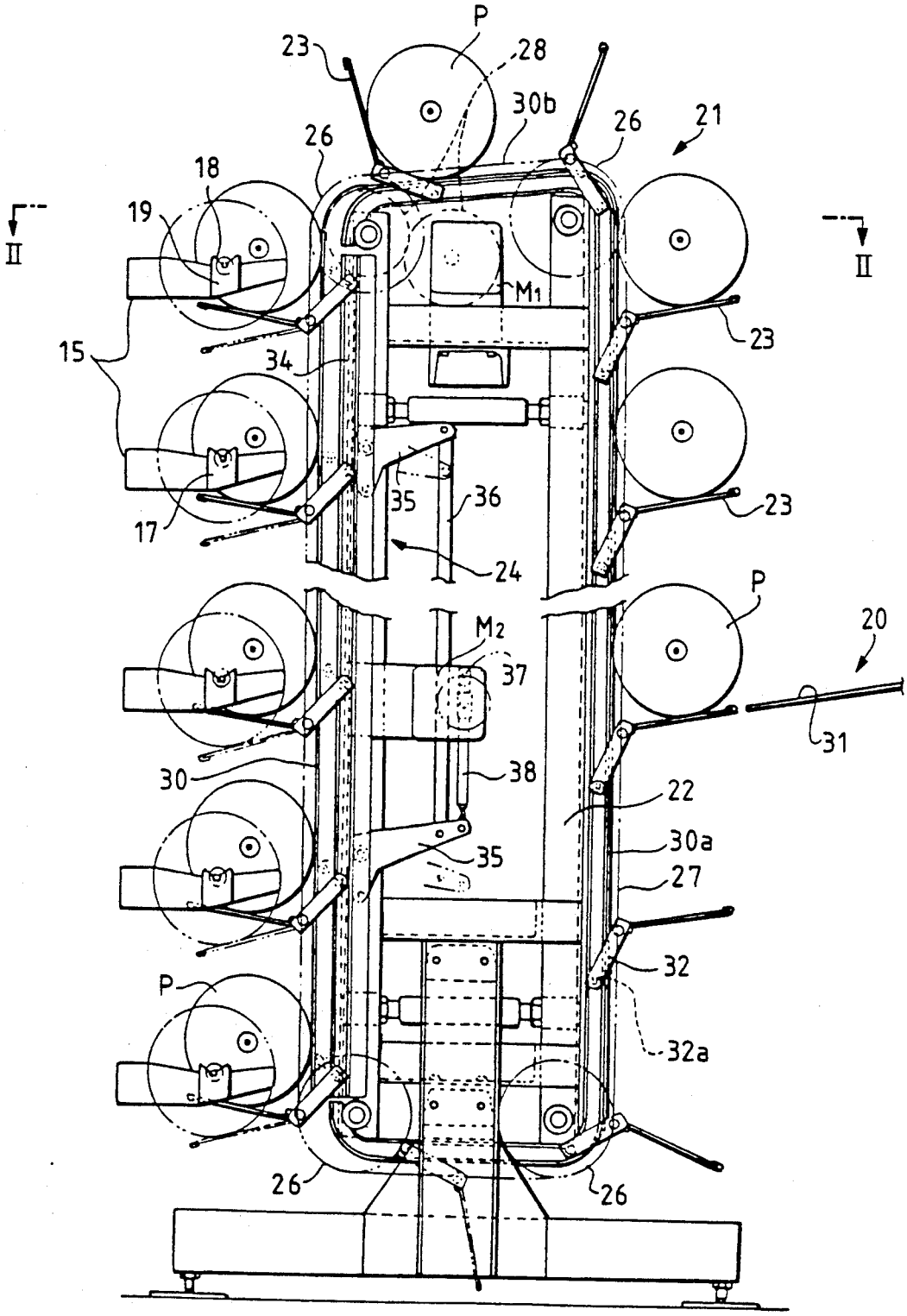
FIG. 1 is a side view of a package transfer apparatus showing one embodiment of the present invention.
Figure 2:
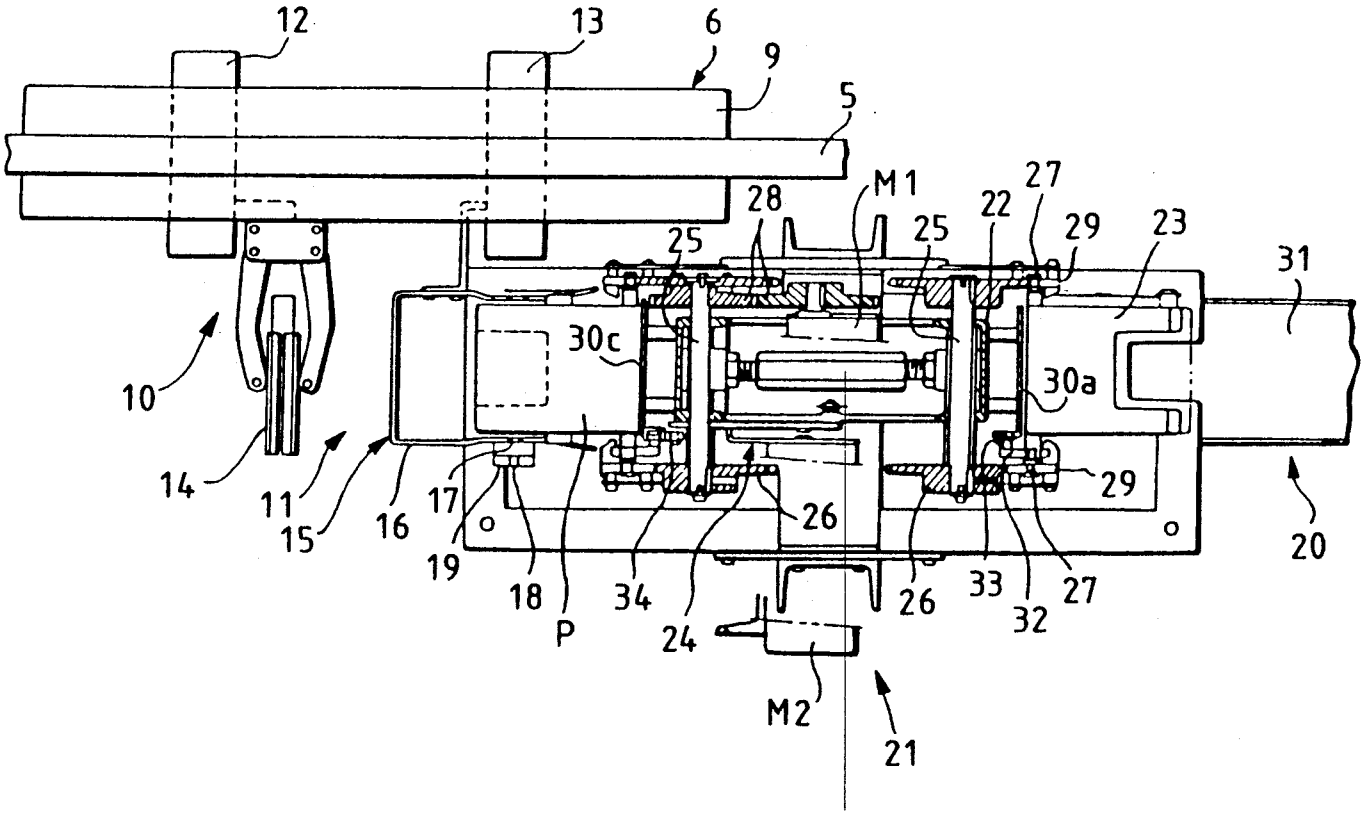
FIG. 2 is a sectional view taken on line II—II of FIG. 1.

The attaching unit 11 has attaching arms 15, which attach the packages P to the pegs 4 of the creel frame 3, mounted thereon in a multistage manner corresponding to the pegs of the creel frame 3, the attaching arms 15 being operated to be elevated simultaneously by an elevating mechanism not shown. The attaching arm 15 has a support frame portion 16 having a plane U-shape opening rearwardly of the travelling direction as shown in FIGS. 1 and 2, the support frame portion 16 being formed at upper edges on both sides thereof with receiving portions 17 for engaging both ends of a bobbin of the package P. A locating member 19 having a V-shaped groove 18 with which the extreme end of the peg 4 is engaged is mounted on the front end of the support frame portion 16.

In the case where the package P is attached to the peg 4, the attaching arm 15 is located below the peg 4 corresponding to the peg 4, in which state the attaching arm 15 is moved forward till the locating member 19 arrives at the extreme end of the peg 4, the attaching arm 15 is then moved upward to cause the V-shaped groove 18 to engage the extreme end of the peg 4, the attaching arm 15 is located thereby and thereafter the attaching arm 15 is further moved forward to insert the package P into the peg 4. After the package P is inserted into the peg 4, the attaching arm 15 is moved downward to separate the package P from the support frame portion 16, the carriage 9 is moved forward at the position where the attaching arm 15 does not interfere with the package P on the peg 4, and thereafter the attaching arm 15 is moved backward and returned.

At the travel start position of the robot 6 is installed a package transfer apparatus 21 for transferring packages P supplied from a package supply section 20 to the attaching arms 15 as shown in FIG. 1 and FIG. 2. The package transfer apparatus 21 has a vertical type frame 22 disposed at said travel start position, said frame 22 being provided for vertical circulation with a plurality of flappers 23 which circulates with the packages P supplied from the package supply section 20 put thereon and further provided with a tilting mechanism 24 which tilts these flappers 23 to transfer the packages P to the attaching arms 15.

More specifically, each pair of sprockets 26 are mounted at four corners of the frame 22 through a rotational shaft 25, an endless roller chain 27 is passed over the sprockets 26, and the flappers 23 are supported at both ends of the base thereof between both the chains 27 in a predetermined spaced relation (the arranging pitch of the attaching arms) along the lengthwise thereof. A motor M1 is connected to one of the rotational shafts 25 through gear 28 so that the flappers 23 are circulated and driven counterclockwise in FIG. 1.

Guide rollers 29 for supporting the chain 27 between both the sprockets 26 are arranged in a suitable spaced relation on the frame 22, and a guide plate 30 positioned between the chains 27 to support and guide the packages P is arranged from the ascend side to descend side. An inclined path **30*b* downwardly inclined is formed between a vertical ascend path 30*a* and a vertical descend path 30*c* formed by the guide plate 30 so that the package P rolls on the inclined path 30*b* and is supported by the front flapper 23**.

The flapper 23 has a width slightly narrower than that of the U-shaped attaching arm 15 and is cut at the extreme end thereof into a recess. At the package supply section 20, a single supply chute 31 is arranged on the ascend path **30*a* side, said chute 31 having a convex portion corresponding to the concave portion of the flapper 23. The flappers 23 positioned on the descend path 30*c* correspond to the plural stages of the attaching arms 15 of the robot 6**.

In order to maintain the flappers 23 at a predetermined attitude (particularly, the attitude in which the package P is supported between the guide plates 30 at the ascend path **30*a* and the descend path 30*c*), a lever 32 having a roller 32*a* is secured to one side of the base of the flapper 23, and a grooved rail 33 for guiding the roller 32*a* is provided loopwise along the chain 27 on the frame 22. Particularly, a vertical descend portion of the grooved rail 33 is separated to form a horizontally displacing movable rail 34. The movable rail 34 and a mechanism for displacing the movable rail 34 constitute a tilting mechanism 24 for tilting the flapper 23 positioned on the descend path 30*c* around the pivot thereof. A crank lever 35 is suitably pivoted heightwise on one side of the frame 22 for displacing the movable rail 34, and the movable rail 34 is pivoted to one end of the crank lever 35. Other ends of the crank levers 35 are connected to each other through a connecting link 36, one crank lever 35 being connected to a crank pin 37 of a motor M2 for turning the crank lever 35 around the pivot thereof through a connecting rod 38. Thereby, in FIG. 1, when the crank pin 37 of the motor M2 is rotated a half revolution, the movable rail 34 is horizontally moved to and from the descend path 30*c* through the crank lever 35, and when the flapper 23 is downwardly tilted from the solid-line position to the imaginary-line position and the crank pin 37 is further rotated a half revolution, the movable rail 34 and the flapper 23** are returned to their original solid-line positions.

The thus configured package transfer apparatus 21 is controlled so that the packages P from the supply chute 31 are carried with the flapper 23 put thereon while circulating the flappers 23; when the first package P arrives at the lowermost end of the descend path **30*c* (S1), the flapper stops circulation; when the robot 6 stops at the travel start position (S2), the flapper 23 is downwardly inclined to transfer the package P to the attaching arm 15; and when completion of the transfer is confirmed (S3) and the robot 6 travels (S4), the flapper 23** is returned to restart circulation. The aforementioned conditions (S1 to S4) are detected, for example, by a photosensor.

Operation of the above-described embodiment will be described hereinafter.

In the package transfer apparatus 21, the motor M1 is driven to circulate the flappers 23 through the chain 27 and the packages P supplied from the supply chute 31 are transported with the packages P put on the flappers 23 on the ascend path **30*a* side. When the flappers 23 with the packages P put thereon arrive at the inclined path 30*b*, the packages P roll and are engaged at the back of the front flapper 23, in which state the packages P are transported along the descend path 30*c***.

When the first package P arrives at the lowermost end of the descend path **30*c*, the flapper 23 stops circulation and assumes a standby state. In this state, when the robot 6 stops at the travel start position, the motor M2 of the tilting mechanism 24 is driven a half revolution to thereby cause the movable rail 34 to move to and from the descend path 30***c* through the crank lever 35 and cause all the flappers 23 on the descend path 3*c* to be downwardly tilted around the respective pivots to collectively transfer the packages P to the attaching arms 15 of the robot 6.

When the robot 6 travels after completion of transfer of the packages P, the flappers 23 are caused to return to their original positions to start circulation.

As described above, the flappers 23 circulate with the packages P put thereon to transfer the latter to the attaching arms 15. Therefore, the package distribution device is not necessary to reduce the space. Moreover, since the flappers 23 are tilted to transfer the packages P to the attaching arms 15, the packages P can be positively transferred to the attaching arms 15 irrespective of the size of the diameter of the package P.

As described above, according to the present invention, the flappers are circulated with the packages put thereon, and the flappers are tilted so as to transfer the packages to the attaching arms of the robot. Therefore, the package distribution device of the prior art is not required, thereby reducing the space needed, and the packages can be positively transferred to the attaching arms irrespective of the size of the diameter of the package.

What is claimed is:

1. A package transfer apparatus for transferring packages supplied from a package supply section to a package receiving device, comprising:

a frame, a plurality of flappers for transferring packages, each flapper circulating about the frame while supporting packages supplied from the package supply section, and a tilting mechanism, attached to the frame, for tilting the flappers to transfer the packages to the package receiving device, wherein the flappers include a base having first and second ends, the flappers being supported at the first and second ends between a plurality of chains passed over sprockets in a predetermined spaced relation along a lengthwise portion of the base, and a lever having a roller is secured to a side of the base to maintain the flapper at a predetermined attitude, wherein a grooved rail for guiding the roller of each flapper is provided loopwise along at least one of the plurality of chains on the frame, a guide plate positioned between the plurality of chains to support and guide packages, wherein the tilting mechanism comprises a movable rail which forms a vertical descend portion of the grooved rail, and a moving mechanism for displacing the movable rail to tilt a flapper having a roller positioned in the vertical descend portion of the grooved rail.

2. A package transfer apparatus as claimed in claim 1, wherein the moving mechanism comprises crank levers pivotally disposed on the movable rail, a connecting link connecting the crank levers to each other, and a crank pin of a motor connected to one crank lever through a connecting rod for turning the one crank lever around a pivot thereof.

3. A package transfer apparatus for transferring packages supplied from a package supply section to a package receiving device, comprising:

a frame, a grooved rail disposed in a loop about the frame, a plurality of flappers for transferring packages, each flapper including a roller movably disposed in the grooved rail, the flappers circulating about the frame while supporting packages supplied from the package supply section, wherein the flappers include a base having first and second ends, wherein the flappers are supported at the first and second ends between a plurality of chains passed over sprockets in a predetermined spaced relation along a lengthwise portion of the base, a lever having a roller is secured to a side of the base to maintain the flapper at a predetermined attitude, and a tilting mechanism, attached to the frame, for tilting the flappers to transfer the packages to the package receiving device, the tilting mechanism including a movable rail which forms a vertical descend portion of the grooved rail, and a moving mechanism for displacing the movable rail to tilt flapper having rollers positioned in the vertical descend portion of the grooved rail.

4. A package transfer apparatus as claimed in claim 3, wherein the moving mechanism comprises crank levers pivotally disposed on the movable rail, a connecting link connecting the crank levers to each other, and a crank pin of a motor connected to one crank lever through a connecting rod for turning the one crank lever around a pivot thereof.

* * * * *